US006435981B2

(12) United States Patent
Naruo et al.

(10) Patent No.: US 6,435,981 B2
(45) Date of Patent: Aug. 20, 2002

(54) METAL GOLF CLUB HEAD

(75) Inventors: Takeshi Naruo; Koji Sakai; Yoshihiro Fujikawa, all of Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/726,604

(22) Filed: Dec. 1, 2000

Related U.S. Application Data

(62) Division of application No. 09/380,770, filed as application No. PCT/JP99/00081 on Jan. 13, 1999.

(30) Foreign Application Priority Data

Jan. 16, 1998 (JP) ..... 10-20392
Feb. 5, 1998 (JP) ..... 10-41058

(51) Int. Cl.[7] ..... A63B 53/04

(52) U.S. Cl. ..... 473/329; 473/342; 473/345; 473/349; 473/350

(58) Field of Search ..... 473/324, 329, 473/330, 345, 346, 349, 350, 342, 332, 290, 291, 292

(56) References Cited

U.S. PATENT DOCUMENTS 3,814,437 A * 6/1974 Winquist
4,214,754 A * 7/1980 Zebelean
4,432,549 A * 2/1984 Zebelean
4,754,969 A * 7/1988 Kobayashi
5,242,167 A * 9/1993 Antonious
5,362,047 A * 11/1994 Shaw
5,405,136 A * 4/1995 Hardman
RE34,925 E * 5/1995 McKeighen
5,489,094 A * 2/1996 Pritchett
5,529,543 A * 6/1996 Beaumont
5,766,093 A * 6/1998 Rohrer
5,799,859 A * 9/1998 Cheng
5,830,084 A * 11/1998 Kosmatka
5,971,868 A * 10/1999 Kosmatka
6,007,432 A * 12/1999 Kosmatka

FOREIGN PATENT DOCUMENTS

| | | |
|---|---|---|
| JP | 55-173527 | 12/1980 |
| JP | 58-45729 | 10/1983 |
| JP | 60-139267 | 7/1985 |
| JP | 2-167181 | 6/1990 |
| JP | 3-24135 | 11/1992 |
| JP | 5-337222 | 12/1993 |
| JP | 7-313637 | 12/1995 |
| JP | 8-308967 | 11/1996 |
| JP | 9-168613 | 6/1997 |
| JP | 9-192273 | 7/1997 |
| JP | 9-299519 | 11/1997 |
| JP | 10-248970 | 9/1998 |

* cited by examiner

*Primary Examiner*—Sebastiano Passaniti
(74) *Attorney, Agent, or Firm*—McDermott, Will & Emery

(57) ABSTRACT

In the metal iron golf club head (1), the rigidity of the medium sensitivity region (5) which is a region on the heel side and excluding the vicinity of the face center (3) is made lower than the rigidity of the low sensitivity region (4) so as to approximate the natural frequency of the metal iron golf club head to the natural frequency of the ball as well as to ensure the strength in the face portion (2).

11 Claims, 5 Drawing Sheets

METAL GOLF CLUB HEAD

This application is a Divisional of application Ser. No. 09/380,770 filed Sep. 13, 1999, which is a 371 of International Application Ser. No. PCT/JP99/00081 filed Jan. 13, 1999.

TECHNICAL FIELD

The present invention relates to a metal golf club head, and more specifically, to a configuration of a face portion that improves the initial speed of the hit ball.

BACKGROUND ART

The present inventors have found from the invention described in Japanese Patent Laying-Open No. 2-167181 that the initial speed of the hit ball increases when a golf club head (hereinafter referred to as a head) is designed to have a natural frequency close to that of the ball. Here, the natural frequency of the head is meant to refer to the natural frequency of the face portion at the time it undergoes the impact of a hit. There are various methods of making the head natural frequency smaller than is conventional to design it to be close to the ball natural frequency. The most effective method is to lower the rigidity of the face portion. Generally, as a method of lowering the rigidity of the face portion, producing a thinner face thickness or using a low elasticity modulus material may be considered.

On the other hand, as a model of an iron golf club, the model having a face member made of titanium alloy fit into the head body is recently becoming popular. The main aim of this model is to achieve an enlarged sweet spot area by utilizing titanium having a light specific gravity for the face portion so that the head periphery portion becomes heavier in weight. Conversely, some models employ a material having a large specific gravity such as tungsten for the sole portion in order to lower the center of gravity of the head.

Moreover, still another model of a metal iron golf club formed by a head body and a face member made of different materials has an opening that penetrates from the face to the opposite side of the face and has the face member fit into the opening. Thus, the face member is exposed inside the cavity. Titanium alloy is mainly employed as the material for the face member. The effect achieved by this model is similar to that achieved by the model in which a plate material made of titanium alloy is fit in as the face member as described earlier. The main objective here, again, is the further enlargement of the sweet spot area achieved by exposing the plate material of titanium alloy inside the cavity. Thus, the plate material fit into the opening is generally smooth except for the scoring lines. The plate material itself in the portion exposed inside the cavity does not show much unevenness besides the logo impression and the like designating the name of the club and the material used.

Since the properties of titanium alloy involves a light specific gravity as well as a low elasticity modulus, titanium alloy shows promise in that it is a material that can lower the rigidity of the face portion, which is a requirement for lowering the head natural frequency. The head utilizing titanium alloy for the face member, however, generally has a cavity structure so that the face thickness of the surface for hitting the ball, though thinner than that of a plain-back type iron golf club, is considerably thick in comparison with the face surface of a wood head. In addition, because the iron golf club and the wood golf club have different structures, their natural frequencies in the range of approximately 1800 Hz to approximately 2000 Hz are largely different from the natural frequencies of the balls in the range of about 800 Hz to about 1000 Hz that vary depending on the type of the ball.

On the other hand, by making the face thickness evenly thin, the strength of the face portion is reduced, leading to the problem of destruction by a hit ball. Thus, as described in Japanese Patent Laying-Open No. 9-192273, there is an invention of a structure in which the face thickness around the sweet spot area has a sufficient strength against the impact due to collision between the ball and the face portion while the face thickness in the region other than the sweet spot area is made thin.

In the head described in Japanese Patent Laying-Open No. 9-192273, however, if the strength of the sweet spot portion on the face is ensured while the portion surrounding the sweet spot portion is made thin, the spring performance of the face portion may certainly improve, although at the same time, the impact of the ball hitting the sweet spot would be supported by the surrounding portion. Since the structure is not designed to support such an impact, the sweet spot portion of the face portion may possibly disadvantageously cave in in the case of an average male golf player hitting the ball with the head speed of about 40 m/s.

Therefore, the main object of the present invention is to clarify the relation between the rigidity and the natural frequency of the face portion and to provide a metal golf club head having the smallest possible head natural frequency while ensuring the strength of the face portion.

DISCLOSURE OF THE INVENTION

The present invention is a golf club head formed of a metal material and having a medium sensitivity region and a low sensitivity region provided on the face portion for hitting a ball, where the face thickness of a part or all of the medium sensitivity region is made thinner than the face thickness in the vicinity of the face center that exist within the low sensitivity region.

According to another aspect, the present invention is a metal golf club head formed by a head body and a face member formed of different materials and having an opening that penetrates from the face to the opposite side of the face with the face member fit into the opening, where a medium sensitivity region and a low sensitivity region are provided on the face portion for hitting the ball, with the face thickness of a part or all of the medium sensitivity region made thinner than the face thickness of the vicinity of the face center that exists within the low sensitivity region.

According to a still another aspect of the present invention, the face thickness of the face portion is varied so that the face thickness of a portion which is within the medium sensitivity region and on the sole side from the low sensitivity region and which is a part or all of the medium sensitivity region excluding the region extending on either side of the face centerline that is within the range of a predefined length of the entire length of the face portion in the toe-heel direction is thinner than the face thickness in the vicinity of the face center existing within the low sensitivity region.

According to a further aspect of the present invention, a region within the medium sensitivity region and having its face thickness made thin is defined as the low rigidity region, and the area of the low rigidity region is selected to be 5% to 50% of the face area.

According to a still further aspect of the present invention, the region other than the low rigidity region in the face member is defined as the high rigidity region, and the face thickness of the low rigidity region is formed at least 0.2 mm thinner than the thickest face thickness of the high rigidity region.

According to a still further aspect of the present invention, the face thickness of the low rigidity region is formed at least 0.5 mm thinner than the thickest face thickness of the high rigidity region.

Further, the face thickness of the low rigidity region is selected to be 0.5 to 2.7 mm. In addition, according to a still further aspect of the present invention, a material having a tensile strength of 100 kgf/mm$^2$ or greater and having a Young's modulus of elasticity of 10000 kfg/mm$^2$ or lower is used for the face member.

According to a still further aspect of the present invention, a recessed portion is formed on the face portion from the face of the head toward the opposite side of the face, and the face member is fit into the recessed portion.

According to a still further aspect, the present invention is a metal golf club head having a hollow portion and formed such that the rigidity of a portion on the heel side of the face portion is made lower than that on the toe side. The head is formed such that the rigidity of the portion excluding the vicinity of the face center is lowered, where the region with the lowered rigidity is defined as the low rigidity region, and the area of the low rigidity region is selected to be in the range of 5% to 50% of the face area.

Moreover, the low rigidity region is formed above the face center or in the lower half region on the heel side.

According to a still further aspect of the present invention, when the region other than the low rigidity region of the face portion is defined as the high rigidity region, the face thickness of the low rigidity region is selected to be thinner than the face thickness of the high rigidity region. Moreover, the face thickness of the low rigidity region is formed at least 0.2 mm thinner than the face thickness of the high rigidity region, and more preferably, a material having a lower elasticity modulus than that of the material used in the high rigidity region is used for the face portion in the low rigidity region.

BEST MODES FOR CARRYING OUT THE INVENTION

At first, the present inventors performed a sensitivity analysis (sensitivity method) to examine which part of the face portion should have its rigidity lowered in order effectively to lower the natural frequency of an iron golf head. The description with regard to the sensitivity analysis will be given below.

At first, on the face surface, a hypothetical lattice-like model is provided with the face center as the starting point and at a spacing of 5 mm in the vertical direction (top-sole direction) and at a spacing of 10 mm in the horizontal direction (toe-heel direction). With an impulse hammer, vibration is caused in an actual iron club, and the transfer function expressing the response is obtained. Curve fitting is performed with the transfer function on a computer to obtain a modal parameter so that the nature of the effect of a certain vibration on the structure can be determined.

Nobuyuki Ohkubo describes in *Machine Modal Analysis* (printed May 1, 1982) published by Chuo University publishing division, that > 'the sensitivity method involves inputting only the modal parameter of the target machine to output "the sensitive parts" of the structure in relation to the vibration mode or the natural frequency to be altered. Thus, the alteration in a high sensitivity portion would allow a greater change in the dynamic characteristic with a smaller amount of alteration.'

As described above, the sensitivity analysis is a method of analyzing which part of a structure may be effectively changed in rigidity so as to effect a change in the natural frequency of the structure. Therefore, the value obtained by this analysis is in terms of sensitivity, and a greater sensitivity value indicates a greater effect of the natural frequency on the change in the rigidity of the structure (i.e. the face surface of the iron according to an embodiment of the present invention).

Figure 2:
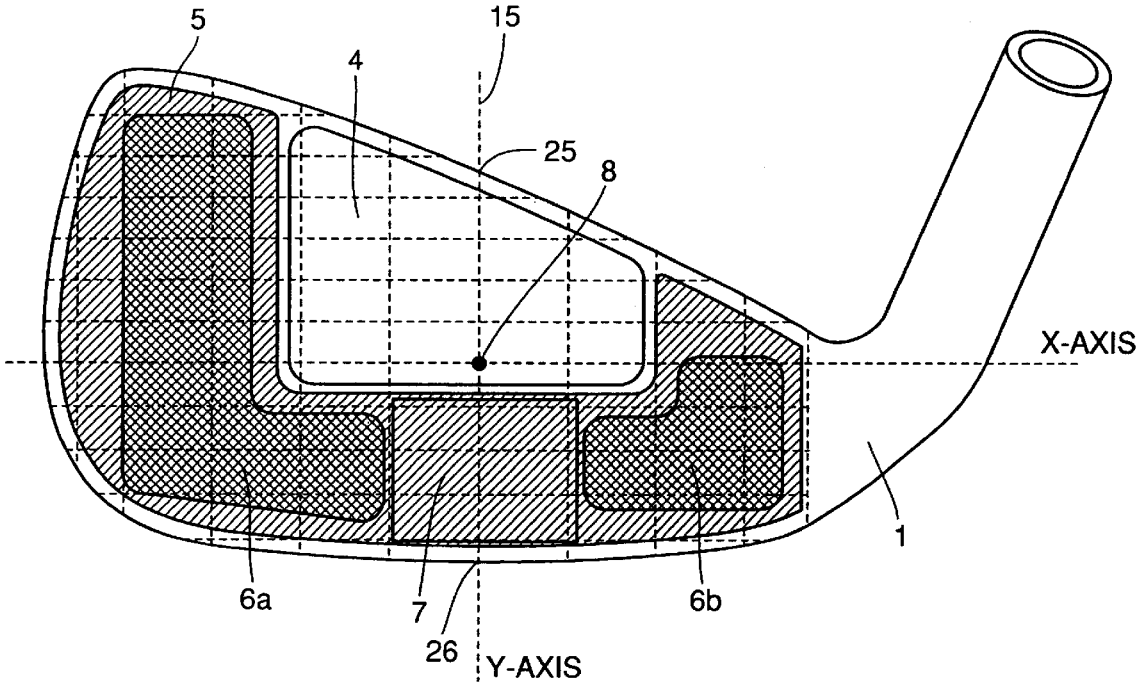
FIG. 2 is a diagram showing the results of sensitivity obtained from the sensitivity analysis in relation to the face portion of a metal iron golf club head.

FIG. 2 shows the results of the sensitivity analysis of a metal iron golf club head color-coded according to the magnitude of the values. Here, sensitivity is the amount of change in the natural frequency calculated when adding a unit elasticity modulus (1 N/m) between each nodal point. For the sake of convenience, the values lower than 15 Hz (N/m) are defined to be of low sensitivity, and the values not smaller than 15 Hz (N/m) is defined to be of medium sensitivity. The parts having indicated values not smaller than 25 Hz (N/m) in the region of the medium sensitivity is defined as a high sensitivity region.

As can be seen from FIG. 2, the region of large sensitivity values is distributed in the portions other than the region that extends from a center top edge 25 of a face portion 2 down to a face center 8. Therefore, it was discovered that, in the case of a metal iron golf club head, lowering the rigidity in the portion other than a region 4 that extends from central top edge 25 down to face center 8 effectively lowers the natural frequency of a metal iron golf club head 1 so that it becomes possible to bring it closer to the ball natural frequency. Thus, the region that extends from center top edge 25 of the above-described face portion 2 down to face center 8 is defined as a low sensitivity region, and the region other than low sensitivity region 4 is defined as a medium sensitivity region 5.

Center top edge 25 is defined as the top edge on a face centerline 15 on the face surface.

In addition, it was discovered that a region having particularly large sensitivity values exists in medium sensitivity region 5. Consequently, it was found that, by lowering the rigidity in such region having particularly large sensitivity values, the natural frequency of metal iron golf club head 1 can be lowered effectively so that it becomes even closer to the natural frequency of the ball. The region having such particularly large sensitivity values is defined as a high sensitivity region 6. As shown in FIG. 2, the region on the toe side within the range of medium sensitivity region 4 is defined as a high sensitivity region 6*a*, and the region on the heel side and also within the range of medium sensitivity region 4 is defined as a low sensitivity region 6*b*.

In other words, the aim of the present inventors, that is, the region which can influence the head natural frequency, was discovered to be different from the region around the sweet spot area as described in Japanese Patent Laying-Open No. 9-192273, so that caving-in of the sweet area by the impact of the ball can be avoided.

Thus, with regard to metal iron golf club head 1, it is possible to lower its natural frequency if the rigidity of medium sensitivity region 5 shown in FIG. 2 can be lowered.

In short, an embodiment of the present invention allows the head natural frequency to be lowered by optimizing the portion in which the rigidity is lowered while preventing the lowering of the strength in the face portion as much as possible by keeping smaller the area of the portion in which the rigidity is to be lowered.

To solve the above-described problem, based on the results given in FIG. 2 discovered from the sensitivity analysis of the metal golf club head, an embodiment of the present invention has the rigidity lowered in medium sensitivity region 5 and high sensitivity region 6 which are portions having large sensitivity values so as to lower the head natural frequency effectively and thus to improve the repulsion of the head while preventing the reduction in the strength of the face portion as much as possible.

Figure 1:
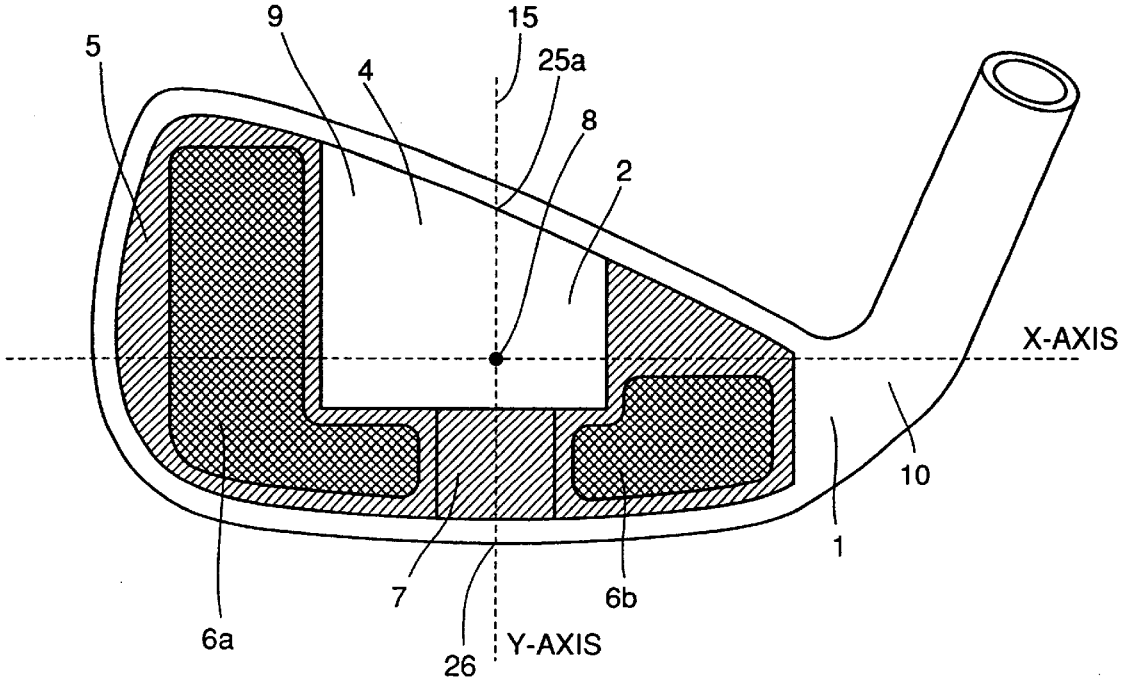
FIG. 1 is a diagram showing a face portion of a metal iron golf club head according to an embodiment of the present invention.

An embodiment of the present invention is shown in FIG. 1. As shown in FIG. 1, according to an embodiment of the present invention, in a metal iron golf head 1 formed by a head body 10 and a face member 9 formed of different materials and having an opening that penetrates from the face to the opposite side of the face with face member 9 fit into the opening, the invention can be implemented in the form of making the rigidity of a part or all of a medium sensitivity region 5 lower than the rigidity in the above-described low sensitivity region 4, and specifically, the invention can be implemented by reducing the face thickness of a part or all of medium sensitivity region 5 to be smaller than the face thickness in the vicinity of the face center that exists in low sensitivity region 4.

In other words, the natural frequency of the head is effectively lowered without making thinner the face thickness in the vicinity of face center 8 that requires the greatest strength. Moreover, in this embodiment, as shown in FIG. 1, low sensitivity region 4 refers to the region enclosed by vertical lines shifted from a face centerline 15 toward the toe side and toward the heel side respectively by approximately 20% of the length of the scoring line from the end point on the heel side up to the toe, and by a horizontal line shifted from a center top edge 25*a* toward face center 8 by approximately 60% of the length from the top of face centerline 15 down to the sole, while medium sensitivity region 5 refers to the region other than the low sensitivity region 4 of face member 9.

Center top edge 25*a* is defined as the top edge on face centerline 15 of face member 9.

In order to produce the effect of this embodiment, there is no particular limit to the area of the region (hereinafter referred to as a low rigidity region) which is within the range of medium sensitivity region 5 and in which the face thickness is made thinner as described above. In order to produce a distinct effect of this embodiment, however, it is desirable that the low rigidity region has an area not smaller than 5% of the face area.

On the other hand, if the low rigidity region is too large, the portion lacking the strength becomes too large, thereby reducing the strength of the face as a whole. Therefore, the area of the low rigidity region is desirably not larger than 70% of the face area, and particularly, for iron golf club heads for men requiring a certain degree of strength in the face portion, it is desired that the area of the low rigidity region is not larger than 50% of the face area.

Moreover, examination of the results of the experiment revealed that high sensitivity region 6 which is a region having particularly large sensitivity values did not exist in the vicinity of face centerline 15 but was distributed on the toe side and on the heel side. Thus, the invention can be implemented without making the face thickness of a region 7, which is defined as the region extending on either side of face centerline 15 in the range of the length which is 5% of the entire length of face portion 2 in the toe-heel direction, as thin as the face thickness of the remaining medium sensitivity region 5.

In addition, this implementation is advantageous in that the head natural frequency can be somewhat reduced while the head strength can be improved, although the head natural frequency cannot be reduced as much as the implementation in which the face thickness of the entire region of medium sensitivity region 5 is made thin.

Further, from the results shown in FIG. 2, the implementation in which the rigidity in high sensitivity regions 6*a* and 6*b* was lowered was found to be effective. In this embodiment, high sensitivity region 6*a* is defined as a region within medium sensitivity region 5 as shown in FIG. 1 and located on the toe side from face centerline 15 but excluding regions 7. High sensitivity region 6*b* refers to the portion within medium sensitivity region 5 as shown in FIG. 1 and located on the heel side and on the sole side from x-axis but excluding region 7.

Thus, in order to lower the natural frequency of the head while limiting the lowering of the strength of face portion 2 as much as possible, the implementation in which the rigidity of high sensitivity region 6 alone is lowered is desirable. Examples of such implementation include the implementation in which the rigidity of at least one of high sensitivity region 6*a* and high sensitivity region 6*b* is lowered, and the implementation in which the rigidity in both high sensitivity regions 6*a* and 6*b* is lowered.

In addition, the invention can be implemented by making the rigidity of high sensitivity region 6 much lower than the rigidity of medium sensitivity region 5. More specifically, it is possible to create the face thickness of high sensitivity region 6 thinner than the face thickness of other medium sensitivity region 5, or to employ a low rigidity material in high sensitivity region 6.

There is no particular limit to the implementation in which the rigidities of the medium sensitivity region and the high sensitivity region within the face portion of a metal iron golf club head are lowered, and the present invention can be implemented by making the face thickness in the medium sensitivity region or the like thinner than the face thickness of the low sensitivity region, or by utilizing for the medium sensitivity region and the like a material of a lower elasticity modulus than the material used in the low sensitivity region.

Here, normally the natural frequency of an iron head formed by a single material is around 2000 Hz. In the iron head having a plate material of titanium alloy inserted in the face portion, a type of an iron head becoming popular in recent years, the natural frequency is about 1800 Hz. In either case, the head natural frequency is quite different from the natural frequency of a ball in the range of 800 to 1000 Hz. In order to abridge the gap of approximately 100 Hz between these natural frequencies, a desirable method should allow the natural frequency to be lowered in relation to both the face thickness and the material.

Therefore, in this embodiment, the head body and the face member are made of different materials, and a material having a low elasticity modulus is used as the material for the face member to lower the rigidity of the entire face portion, thereby taking advantage of the effect of the embodiment more fully. When different materials are used for the head body and the face member to form the iron golf club head, stainless steel is generally used for the head body while titanium alloy is most suitably used for the face member.

Further, when the invention is implemented for the head having an opening that penetrates from the face to the opposite side of the face, the rigidity of the entire face portion can be further lowered so that the head natural frequency can be brought even closer to the ball natural frequency. It is also effective to increase the area of exposure inside the cavity of the face member in order to lower the rigidity of the face portion.

Moreover, according to the results from the sensitivity analysis, that is, due to the fact that high sensitivity regions 6*a* and 6*b* have large sensitivity values, the regions on the backside of face member 9 and corresponding to high sensitivity regions 6*a* and 6*b* are preferably exposed inside the cavity, allowing the rigidity to be further lowered.

In this case, there is no limitation as to the material to be used for the face member, and the invention may be implemented using various materials, such as stainless steel, titanium alloy, aluminum alloy, and magnesium alloy. From the aspects of strength and lowness of elasticity modulus, either α-type or β-type titanium alloy is suitable for face member 9, and especially β-type titanium alloy having high strength and a low elasticity modulus is desirable. More specifically, β-type titanium alloy having a tensile strength of 100 kgf/mm$^2$ or greater and having a Young's modulus of elasticity of 10000 kfg/mm$^2$ or lower is preferred.

In short, in order fully to bring out the effect of this embodiment, it is desirable to implement the invention for a metal iron golf club head formed by a head body and a face member, and having an opening that penetrates from the face to the opposite side of the face, with face member 9 fit into the opening.

Here, in order to lower the rigidity of the portion which relates to the lowering of the natural frequency of the head in the most effective manner as discovered by the sensitivity analysis as described above, the method of making the face thickness of that portion thinner is suggested.

In the implementation in which the face thickness of the medium sensitivity region is made thinner than the face thickness of the low sensitivity region, the face thickness of the low rigidity region within the medium sensitivity region having its face thickness made thinner and the face thickness of a high rigidity region within the low sensitivity region should be determined by the material used for the face portion and by the head speed of the target golf player, and thus, are not limited to any particular values. In other words, since the object of this embodiment lies in bringing the natural frequency of the head close to that of the ball, the degree of face thickness in the low rigidity region and the high rigidity region is to be determined in relation to such factors as the face material, the face shape, and the area of the face.

Next, as a more specific embodiment of the present invention, there is no particular limit to the face thickness of the high rigidity region, and the value of the face thickness is determined by the material used. More specifically, as with a normal golf club, with titanium alloy or stainless steel the face thickness can be implemented in the range of 2.0 to 5.0 mm while with aluminum alloy or magnesium alloy the face thickness may be implemented in the range of 2.5 to 8.0 mm. When considering only the effect of lowering the head natural frequency, it can be said that a thin face thickness is desirable also in the high rigidity region. The high rigidity region, however, is a part requiring the strength to endure the impact of the hit ball. Therefore, when using titanium alloy having a high strength for the material to form the face member, face thickness of about 2.5 mm to about 3.0 mm would be suitable for the high rigidity region. Moreover, when using aluminum alloy for the face member, face thickness of about 3.0 mm to about 4.0 mm would be appropriate.

If the face thickness of the low rigidity region is too thick, the effect of lowering the head natural frequency cannot be achieved. Thus, in the case of a male player whose normal head speed is about 40 m/s, the face thickness of the low rigidity region is preferably not greater than 2.7 mm. On the other hand, a face thickness that is too thin can create disadvantages such as increased difficulty during the polishing process and poor production yield. Consequently, the face thickness of the low rigidity region should be not smaller than 0.7 mm.

When titanium alloy is used as the material for the face member, the face thickness of the low rigidity region must be within the range of 0.7 to 2.7 mm for the same reason.

Moreover, in this embodiment, the natural frequency of the head can be brought closer to that of the ball by making the face thickness of the low rigidity region thinner than the face thickness of the high rigidity region so as to limit the reduction of the head strength as much as possible while lowering the natural frequency of the head. Accordingly, it can be said that a thinner face thickness in the low rigidity region is more desirable.

If, however, the difference in face thickness between these regions is too small, a distinct effect of this embodiment cannot be achieved. Thus, the difference in face thickness between the low rigidity region and the high rigidity region should be not smaller than 0.2 mm, and further, a desirable difference in face thickness is not smaller than 0.5 mm to ensure a distinct effect of this embodiment.

Thus, according to one embodiment of the present invention, the face thickness of the high rigidity region can be implemented to be in the range of 2.0 to 5.0 mm when using titanium alloy or stainless steel for the face member, or in the range of 2.5 to 8.0 mm when using aluminum alloy or magnesium alloy, while the face thickness of the low rigidity region is implemented in the range of 0.7 to 2.7 mm, with the difference between the face thickness of the high rigidity region and the face thickness of the low rigidity region not smaller than 0.2 mm. Further, the desirable difference in face thickness is not smaller than 0.5 mm.

Furthermore, in the case of golf clubs intended for golf players with slow head speeds such as those intended for women, while it is possible to reduce the strength of the high rigidity region and the low rigidity region further than usual, at the same time, clubs having a lighter weight than normal golf clubs must be produced. Thus, the face thickness of the high rigidity region can be implemented in the range of 1.5 to 4.0 mm when using titanium alloy or stainless steel for the face member, or in the range of 1.5 to 5.0 mm when using aluminum alloy or magnesium alloy, and the face thickness of the low rigidity region can be implemented in the range of 0.5 to 2.5 mm, with the difference in face thickness between low rigidity region and the high rigidity region not smaller than 0.2 mm.

Therefore, when the golf clubs for women are also taken into consideration, the face thickness of low rigidity region can be implemented in the range of 0.5 to 2.7 mm.

In addition, this embodiment can be implemented for all types of metal iron golf club heads, regardless of the head shape, the loft angle, the head weight, or the club type. Thus, it can be implemented with a No. 1 iron down to a No. 9 iron as well as with a PW, an SW, an AW, an FW and the like.

Figure 3:
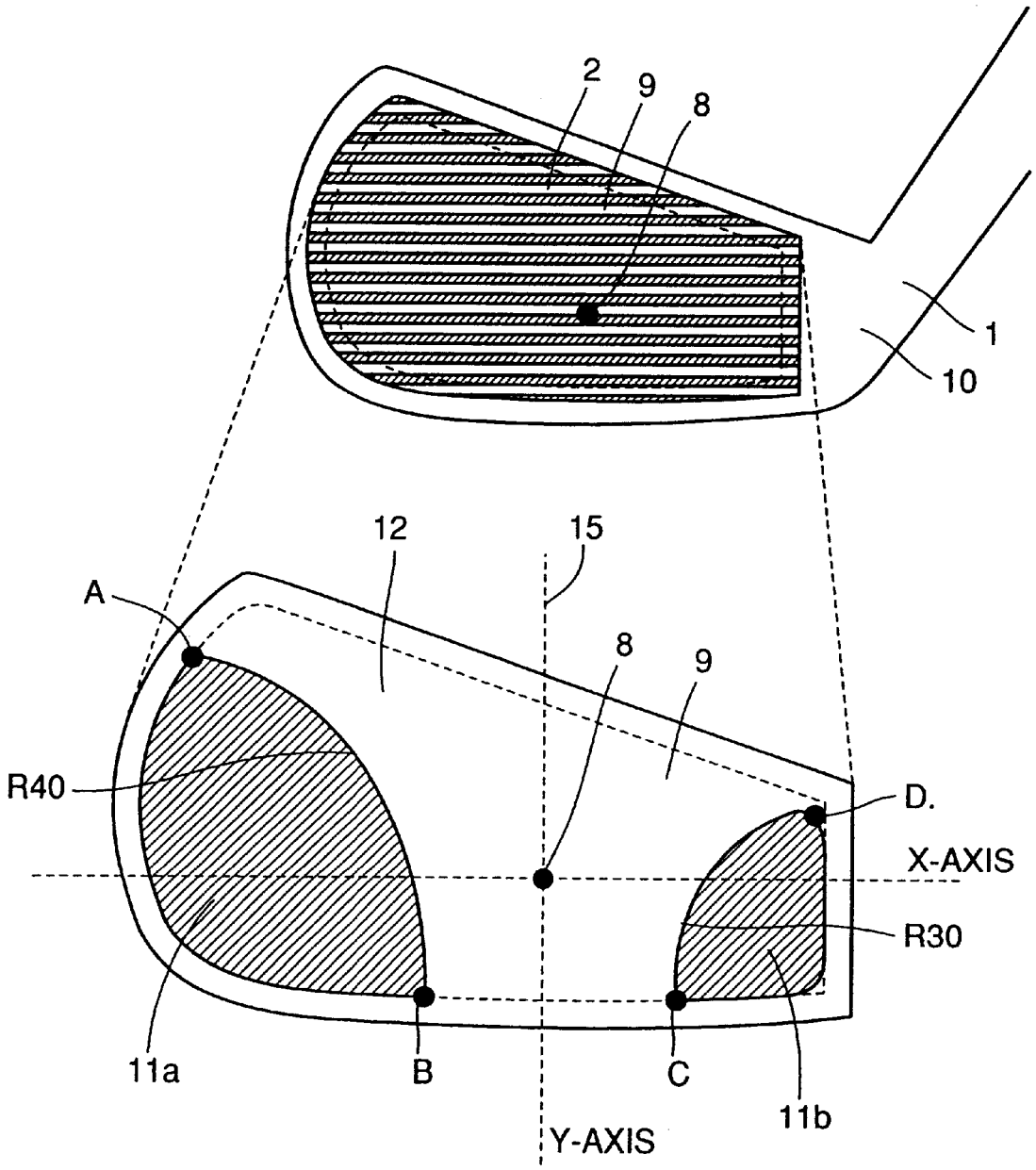
FIG. 3 is a diagram showing a more specific embodiment in relation to the face portion of a metal iron golf club head.

Now, a metal iron golf club head according to an embodiment of the present invention will be described using FIG. 3. FIG. 3 is a diagram showing the face portion and the face member of a metal iron golf club head, with the enlarged view of the face member representing particularly the face member seen from the front, while the difference of face thickness is expressed by the tone. That is, in the diagram, the colored portion represents low rigidity region (11) where the face thickness is thin, and the non-colored portion represents high rigidity region (12).

In addition, a face center 8 denotes the intermediate point between the top and the bottom of face member 9 along the extended line of a face centerline 15.

Moreover, needless to say, since face center 8 is represented by a value which greatly influences the shape and the material of the club head, different values must be considered corresponding to the different types of club heads.

The embodiment shown in FIG. 3 is an embodiment of a No. 5 iron. Stainless steel was used as the material for head body 10, and β-type titanium alloy, among titanium alloys, which has a high strength and a low elasticity modulus, was used for face member 9. The face shape was as shown in FIG. 3, with the face area being 38.7 $cm^2$, the head length being 88 mm, and the head weight being 261 g. In addition, face member 9 was constructed such that it was exposed inside the cavity, with the area of the cavity portion being 32 $cm^2$.

The average value of the face thickness of high rigidity region 12 was set to the same value as that of a conventional product, i. e. 3.0 mm. Three different values were used for the face thickness of low rigidity region 11, which were 2.5 mm, 2.0 mm, and 1.0 mm. Embodiment 1 utilized the face thickness of 2.5 mm for low rigidity region 11, embodiment 2 utilized the face thickness of 2.0 mm, and embodiment 3 utilized the face thickness of 1.0 mm. Here, low rigidity regions 11*a* and 11*b* were defined as follows. First, as shown in FIG. 3, the coordinates of face center 8 was set to the point (0, 0) (unit: mm). With the x-axis being the toe-to-heel direction (heel direction being positive) and the y-axis being the top-to-sole direction (top direction being positive), the region enclosed by the curved line connecting the coordinates A (−38, 16) and the coordinates B (−15, −15) and having R of about 40 mm and by the outer circumference of the cavity was defined as low rigidity region 11*a*, and the region enclosed by the curved line connecting the coordinates C (15, −17) and the coordinates D (25, 5) and having R of about 30 mm and by the outer circumference of the cavity was defined as low rigidity region 11*b*.

Moreover, as comparative samples, two kinds of conventional products were prepared: a commercial product having a head formed of a single material of soft iron and a commercial product utilizing titanium alloy in the face portion but not having it exposed inside the cavity (with the thickness of the member forming the face portion being 3.0 mm). The iron head using soft iron is referred to as a conventional product 1, and the commercial product utilizing titanium alloy in the face portion but not having it exposed inside the cavity is referred to as a conventional product 2.

Table 1 shows the measured results of the natural frequencies of the embodiments and the conventional products.

TABLE 1

| | Thickness of high rigidity region (mm) | Thickness of low rigidity region (mm) | Difference in thickness of high and low rigidity regions (mm) | Natural Frequency (Hz) |
|---|---|---|---|---|
| Conventional product 1 | 13.1 | — | — | 2037.5 |
| Conventional product 2 | ~~X~~4.5 | — | — | 1850.0 |
| Embodiment 1 | 3.0 | 2.5 | 0.5 | 1210.0 |
| Embodiment 2 | 3.0 | 2.0 | 1.0 | 1145.0 |
| Embodiment 3 | 3.0 | 1.0 | 2.0 | 895.0 |

*The thickness of conventional product 2 includes the thickness (3 mm) of a titanium alloy plate material.

It can be seen from the table that the value of the natural frequency of embodiment 3 is the smallest among the embodiments, and that the natural frequency becomes lower as the face thickness of low rigidity region 11 becomes thinner.

It is also seen that the respective natural frequencies of embodiments 1, 2 and 3 having their face thickness in low rigidity region 11 made thinner are drastically lowered in comparison with the respective natural frequencies of conventional products 1 and 2 (2038 Hz for conventional product 1, 1850 Hz for conventional product 2). Considering that the natural frequency of the golf ball, although it may more or less vary from kind to kind, is within the range of about 800 Hz to about 1000 Hz, the inventors were successful in realizing in these embodiments the values of the natural frequencies which are in about the same range as the natural frequency of a golf ball.

From the above, in the attempt to bring the natural frequency of the head closer in range to the natural frequency of the ball by making the face thickness of low rigidity region 11 thin, it can be concluded that sufficient effect was observed by forming the face thickness of low rigidity region 11 at least 0.5 mm thinner than high rigidity region 12. The fact that forming the face thickness of low rigidity region 11 at least 0.5 mm thinner than high rigidity region 12 has proved effective, however, is only applicable to the head implementation according to the present embodiment. In the case of a head utilizing a material having a lower elasticity modulus than that used in the present embodiment or in the case of a head having an enlarged face area, the head natural frequency can be brought closer to the ball natural frequency with the difference in face thickness between the high rigidity region and the low rigidity region being as small as about 0.2 mm.

Then, in addition to the measurement of the natural frequencies described earlier, tests relating to repulsion were carried out. The heads used for the testing were the above-described embodiments 1, 2, and 3, and conventional products 1 and 2.

The tests carried out here in relation to repulsion involved shooting the ball against the tested heads at a speed of about 37 m/s, which is about the same speed as the 5I head speed of an average golf player, in order to evaluate the quality of repulsion from this speed and the speed at which the ball bounces back. The heads implementing the present invention and the conventional product heads were tested.

Figure 4:
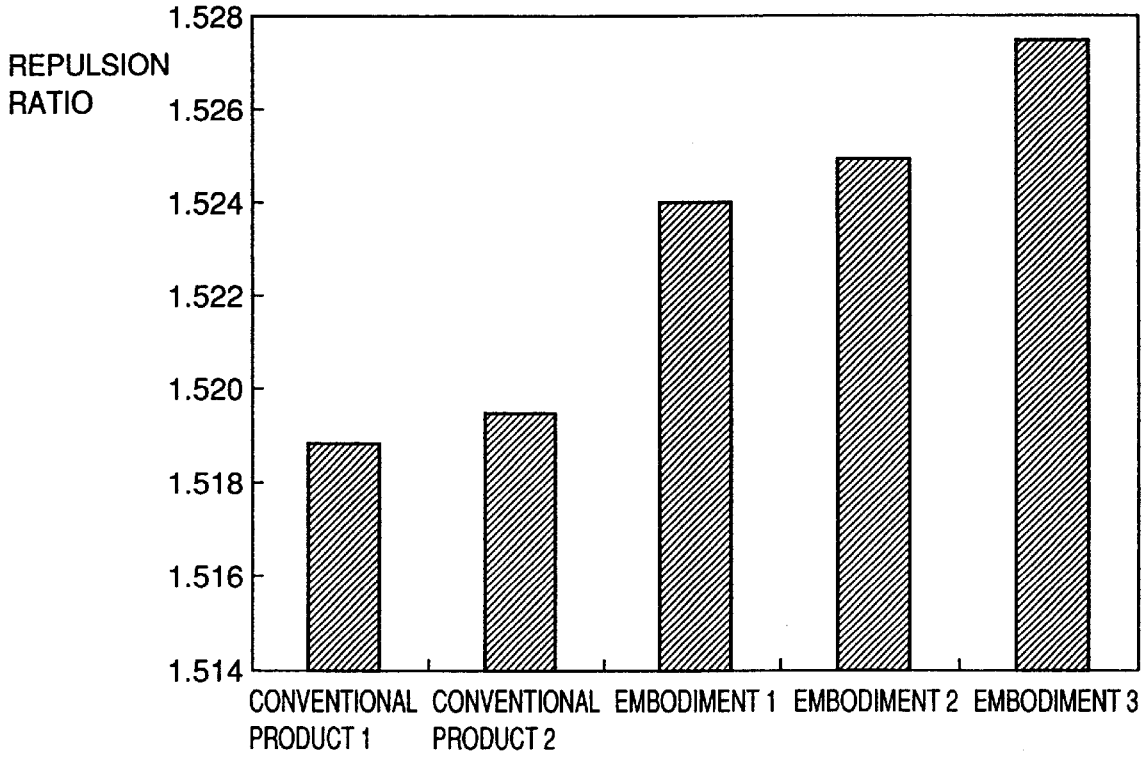
FIG. 4 is a graph representing the measurement results in relation to the repulsion in the embodiment of FIG. 3.

The results are shown in FIG. 4 as the head repulsion ratios.

The repulsion ratio was calculated as follows:

Repulsion ratio=shot-out speed of ball/head speed=(ball reflection rate+ball impingement rate)/ball impingement rate As can be seen from FIG. 4, the repulsion ratios for all the embodiments are higher in comparison with those for the conventional products. Moreover, among the embodiments, the repulsion ratio of embodiment 3 indicated the largest value. It was found that an embodiment having a thin face thickness in the low rigidity region and having a natural frequency close to that of the ball natural frequency had a good repulsion ratio.

As described above, according to an embodiment of the present invention, in a metal iron golf club head being formed by a head body and a face member made of different materials and having an opening that penetrates from the face to the opposite side of the face, by forming the face thickness of a part or all of medium sensitivity region 5 thinner than the face thickness of an average value in low sensitivity region 4, the natural frequency of the head can be brought closer to the natural frequency of the ball without reducing the strength of the face, while improving the repulsion between the head and the ball.

Figure 6:
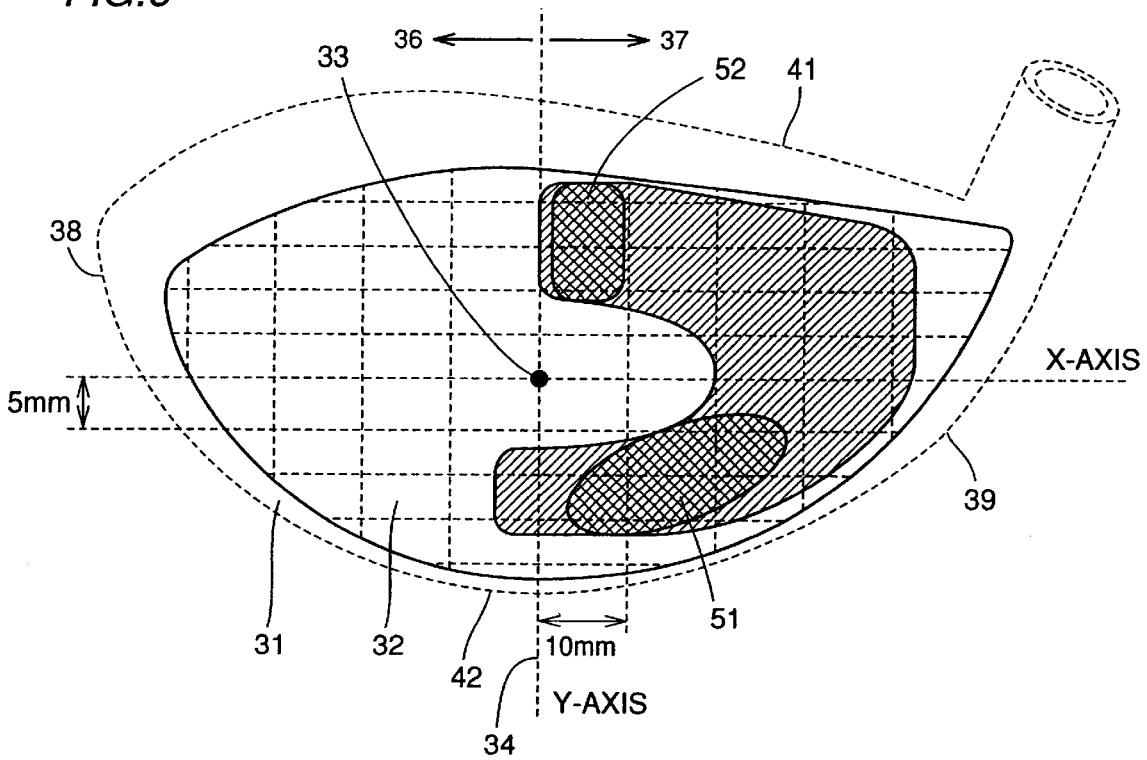
FIG. 6 is a diagram showing the results of sensitivity obtained from the sensitivity analysis in relation to the face portion of a metal golf club head having a hollow portion.

Next, the sensitivity analysis was performed to examine which part of the face portion should have its rigidity lowered in order to lower the natural frequency of another model of a golf club, i. e. the head having a hollow portion. The results for a metal golf club head having a hollow portion are shown in FIG. 6. In handling the results, the magnitude of the value of sensitivity obtained by the sensitivity analysis becomes the indices indicating the magnitude of the influence to be effected on the natural frequency. In other words, the natural frequency of the head can be more effectively lowered by lowering the rigidity of a portion having large sensitivity values. FIG. 6 color-codes the magnitudes of the sensitivity values according to the results of such sensitivity analysis.

As seen from FIG. 6, the region having large sensitivity values lies in the region on the heel side 37 of a face centerline 34 and excluding the vicinity of a face center 33. Thus, in the case of a metal golf club head having a hollow portion, it was found that the natural frequency of the golf head can be effectively lowered and be brought closer to the natural frequency of the ball by lowering the rigidity in the portion on heel side 37 of face centerline 34 and excluding the vicinity of face center 33.

Therefore, in order to lower the head natural frequency, it was discovered not always to be appropriate to require the thickness of the entire portion other than the vicinity of the sweet area to be made thin as described in the above-mentioned Japanese Patent Laying-Open Nos. 9-168613 and 9-192273.

Thus, the natural frequency of a metal golf club head having a hollow portion can be lowered if the rigidity of the region on the heel side of the face centerline of the face portion and excluding the vicinity of the sweet area, as shown in FIG. 6, can be lowered.

Figure 5:
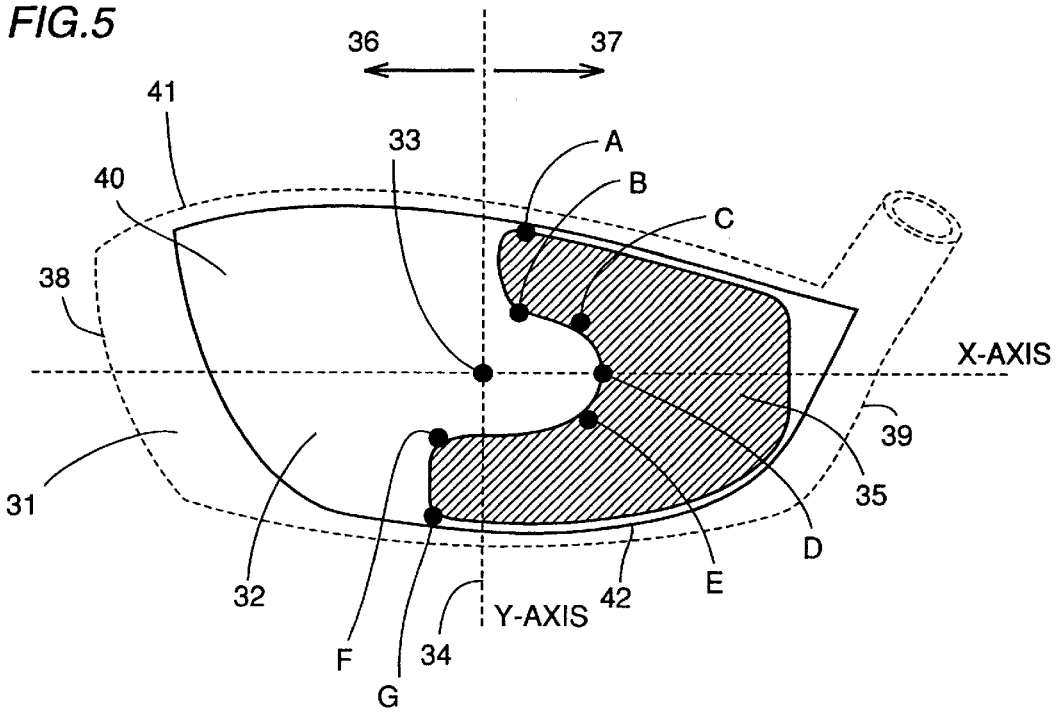
FIG. 5 is a diagram showing a metal golf club head having a hollow portion according to another embodiment of the present invention.

It can be seen from FIG. 6 that the portion having large sensitivity values is located mainly on heel side 37. Therefore, it was found that making the rigidity in a portion of heel side 37 lower than that in a toe side 36 would prove effective. Here, the heel side refers to heel side 37 on the right side of face centerline 34 as shown in FIG. 5. It was also discovered that, since the sensitivity values of toe side 36 are extremely small, lowering the rigidity in this portion would not be so effective in lowering the natural frequency of the head. Here, the toe side refers to toe side 36 on the left side of face centerline 34 as shown in FIG. 5.

Thus, this embodiment can be implemented by making the rigidity in a portion of the heel side lower than the rigidity of the toe side.

Further, in producing the effect of this embodiment, there is no particular limit as to the area of the region in which the rigidity is made lower (hereinafter referred to as a low rigidity region). In order to produce a distinct effect of this embodiment, however, it is desirable that the region in which the rigidity is lowered has an area that is not smaller than 5% of the face area.

On the other hand, if the low rigidity region is too large, the portion lacking the strength becomes too large, thereby reducing the strength of the face as a whole. Therefore, the area of the low rigidity region is desirably not larger than 50% of the face area.

Moreover, examination of the results of the experiment revealed that the sensitivity values around face center 33 were small. In addition, this region is the so-called sweet area which undergoes the impact of the ball, and thus requires sufficient strength to endure the impact. From these two points, it was concluded that there was no need to lower the rigidity in the region around face center 33.

Furthermore, since the sensitivity values in a region 51 shown in FIG. 6 are large, the implementation in which the rigidity of such region 51 is lowered was also found to be effective. Here, region 51 refers to the region on heel side 37 and on the sole side of face center 33, and located substantially midway between face centerline 34 and heel 39, as shown in FIG. 6.

In addition, since the sensitivity values in a region 52 shown in FIG. 6 are also large, the implementation in which the rigidity of such region 52 is lowered was also found to be effective. Here, region 52 refers to a region within a larger region on heel side 37 and on the crown side of face center 33, and when the larger region thus defined is divided generally in half in the crown-sole direction, region 52 is located in the region closer to the crown side and in the vicinity of the face centerline, as shown in FIG. 6.

Since the portions having particularly high sensitivity values are regions 51 and 52, the head natural frequency is more effectively lowered by implementing both of these regions as low rigidity regions.

Thus, there is no particular limitation as to the location of the low rigidity region as long as it is within the range of the heel side of the face portion.

In the face portion of the metal golf club head having a hollow portion, there is no limitation as to how the rigidity of the low rigidity region is lowered. Thus, the thickness of the low rigidity region may be made thinner than the thickness of the region other than the low rigidity region (hereinafter referred to as a high rigidity region), or a material having a lower elasticity modulus than that of the material used in the high rigidity region may be utilized for the low rigidity region.

The invention can also be implemented by attaching a material having a high elasticity modulus on the back of the face portion of the high rigidity region after having formed the head to have an even face thickness.

As regards the cost, it is desirable that this embodiment is implemented by forming the thickness of low rigidity region thinner than the thickness of the high rigidity region.

On the other hand, it is also effective to make the difference in the elasticity modulus of the materials used in the high rigidity region and the low rigidity region greater in order to make the difference in rigidity between the two regions greater. In such a case, the use of a material having a lower elasticity modulus than that of the material used in the high rigidity region for the low rigidity region is preferred.

Further, regarding the ease of construction, the implementation in which a high elasticity modulus material is attached on the back of the face portion of the high rigidity region is preferred.

In the case in which the thickness of the low rigidity region is made thinner than the thickness of the high rigidity region, the values of the thickness of the face portion and of the difference in thickness between the low rigidity region and the high rigidity region should be determined by the material used for the face portion and by the head speed of the target golf player, and thus, are not limited to any particular values.

In other words, since the object of this embodiment lies in bringing the natural frequency of the head close to that of the ball, the thickness of the low rigidity region is to be determined in relation to such factors as the face material; the thickness of the face portion; that is, of the portion that serves as the high rigidity region in this embodiment; the area of the face; and the shape of the head.

Here, as a material for forming the face, titanium alloy having high strength and a low elasticity modulus, is desirable, for instance, since titanium alloy allows the face portion to be made thin. Normally, the thickness of the face portion formed with an even thickness is in the range of 2.5 to 3.0 mm for a 1W. According to this embodiment, however, this thickness is only applied to the high rigidity region, while the thickness of the low rigidity region is made at least 0.2 mm thinner. As a result, the rigidity in the face portion can be further lowered, and the natural frequency of the head can be brought closer to that of the ball.

Since the results obtained from the sensitivity analysis depend on the structure of the golf club head and are not limited to the material used as long as it is a metal golf club head having a hollow portion, the present embodiment is applicable to metal golf club heads formed with stainless steel, aluminum alloy, or the like besides the above-described titanium alloy. Even in this case, the difference in thickness of at least 0.2 mm is required, as was the case with titanium alloy, in order to achieve a distinct effect of the present invention.

For instance, in the case of golf clubs intended for golf players with slow head speeds such as those intended for women, since the strength of the low rigidity region can be lowered than usual, the difference in thickness between the low rigidity region and the high rigidity region is preferably at least 0.5 mm.

If the face thickness of the low rigidity region is too thick, the effect of lowering the head natural frequency cannot be achieved. Thus, in the case of a male player whose normal head speed is about 40 m/s, with stainless steel being the material used for the face portion, the face thickness of the low rigidity region is preferably not greater than 2.6 mm. On the other hand, a face thickness that is too thin can create disadvantages such as increased difficulty during the polishing process and poor production yield. Consequently, the face thickness of the low rigidity region should be not smaller than 0.5 mm.

Moreover, when titanium alloy is used as the material for the face portion, the face thickness of the low rigidity region must be within the range of 0.5 to 2.5 mm for the same reason.

The difference in the thickness of the low rigidity region and the high rigidity region has thus far been discussed above. When implementing the present invention with a golf club head having a face portion formed with an even thickness, the thickness of the high rigidity region may be about the same as that of a commercially available model. That is to say, in the case of a 1W, the desirable thickness when using titanium alloy is about 2.5 to about 3.0 mm, as described earlier, and the desirable thickness when using stainless steel is about 2.6 to about 2.8 mm.

In addition, when utilizing for the low rigidity region a material having a lower elasticity modulus than that of the material used in the high rigidity region, the material used for the face portion is not limited to any particular material as long as it is a material normally used for a golf head. In other words, the face portion may be implemented using stainless steel, aluminum alloy, titanium alloy, or the like.

Since the high rigidity region includes a sweet spot and thus is required to have high strength, the suitable material for the high rigidity region would be titanium alloy or stainless steel. On the other hand, the low rigidity region requires a small elasticity modulus as well as a certain degree of strength. Therefore, the use of $\alpha$-type titanium alloy such as pure titanium and 6-4 titanium for the high rigidity region in combination with the use of $\beta$-type titanium or the like for the low rigidity region, or the use of stainless steel for the high rigidity region in combination with the use of titanium alloy for the low rigidity region is suitable.

Further, for a high head speed golf player, the use of titanium alloy for the low rigidity region in combination with the use of stainless steel for the high rigidity region is desirable, while for a low head speed golf player, the use of aluminum alloy for the low rigidity region in combination with the use of titanium alloy in the high rigidity region is desirable.

The face thickness of the low rigidity region need not be the same as the face thickness of the high rigidity region. Considering the ease of construction, however, it is preferable that the face thicknesses are equal. In order to enlarge the difference of rigidity between these regions, the low rigidity region is preferably formed by a low elasticity modulus material, and further, the face thickness of the low rigidity region is made thin.

In addition, this embodiment can be implemented in all types of metal iron golf club heads having a hollow portion, without limitation as to the head shape, the loft angle, the head weight, or the club type. Thus, it can be implemented with a 1W, a 2W, a 3W, a 4W, a 5W, and the like.

An embodiment of a metal golf club head according to the present invention will be described in relation to FIG. 1.

FIG. 5 is a diagram showing an embodiment of the present invention in relation to the face portion of a metal golf club head having a hollow portion.

In this embodiment, the sweet area was designed as an ellipse having a major axis of about 20 mm and a minor axis of about 10 mm with a face center 3 serving as its center. In addition, face center 3 designates the intermediate point between the top and the bottom of face portion along the extended line of a face centerline 4.

Needless to say, since the sweet area and the face center are represented by values which greatly influence the shape and the material of the club head, different values must be considered corresponding to the different types of club heads.

The embodiment shown in FIG. 5 employs titanium alloy as a material. The face shape is as shown in FIG. 1, with the face area being 30 $cm^2$, the face length being 95 mm, the face height being 44.5 mm, and the head weight being 207 g.

The face thickness of high rigidity region 40 was set to the same value as a conventional product, i. e. 2.8 mm. Three different values were used for the face thickness of low rigidity region 35, which were 2.3 mm, 1.8 mm, and 1.3 mm. Embodiment 4 utilized the face thickness of 2.3 mm for low rigidity region 35, embodiment 5 utilized the face thickness of 1.8 mm, and embodiment 6 utilized the face thickness of 1.3 mm.

Here, as shown in FIG. 5, with the coordinates of face center 33 set to the point (0, 0) (unit: mm) where the x-axis is the direction from the toe 38 to the heel 39 of a metal golf club head 31 (heel direction being positive) and the y-axis is the direction from the crown 41 to the sole 42 (crown direction being positive), the low rigidity region refers to the region on the heel side 37 from the line connecting the coordinates A (5, 20), B (5, 10), C (15, 5), D (20, 0), E (15, −5), F (−5, −10), and G (−5, −20), represented as the shaded portion in FIG. 5.

Moreover, as a comparative sample, a conventional product made of the same titanium alloy, having the face thickness of 2.8 mm, and having the same shape and approximately the same weight as each of the inventive metal golf club head product was prepared.

Table 2 shows the measured results of the natural frequencies of the embodiments and the conventional metal golf club head product.

TABLE 2

| | Thickness of low rigidity region (mm) | Difference in thickness of high and low rigidity regions (mm) | Natural frequency |
|---|---|---|---|
| Conventional product | 2.8 | — | 1190.0 |
| Embodiment 4 | 2.3 | 0.5 | 990.0 |
| Embodiment 5 | 1.8 | 1.0 | 890.0 |
| Embodiment 6 | 1.3 | 1.5 | 797.5 |

It can be seen from Table 2 that the natural frequency is smaller in an inventive product having a thinner face thickness in low rigidity region 35. Therefore, it can be concluded that the natural frequency of the metal golf club head is lowered as the face thickness of low rigidity region 5 becomes thinner, and thus, as the rigidity is lowered.

It is also seen that, in the embodiments having the face thickness of their respective low rigidity regions made thinner, the respective natural frequencies are drastically lowered in comparison with the natural frequency of the conventional products, i. e. 1190 Hz. Considering that the natural frequency of the golf ball, although it may more or less vary from kind to kind, is within the range of about 800 Hz to about 1000 Hz, the inventors were successful in realizing in these embodiments the values of the natural frequencies which are in about the same range as the natural frequency of a golf ball.

From the above, in the attempt to bring the natural frequency of the head closer in range to the natural frequency of the ball by making the face thickness of the low rigidity region thin, it can be concluded that sufficient effect was observed by forming the face thickness of the low rigidity region at least 0.5 mm thinner than the high rigidity region.

The fact that forming the face thickness of the low rigidity region at least 0.5 mm thinner than the high rigidity region has proved effective, however, is only applicable to the head implementation according to the present embodiment. In the case of a head utilizing a material having a lower elasticity modulus than that used in the present embodiment or in the case of a head having an enlarged face area, the head natural frequency can be brought closer to the ball natural frequency with the difference in thickness between the high rigidity region and the low rigidity region being as small as about 0.2 mm.

Then, in addition to the measurement of the natural frequencies described earlier, tests relating to repulsion were carried out.

The tests carried out here in relation to repulsion involved shooting the ball against the tested heads at a speed of about 40 m/s, which is about the same speed as the driver head speed of an average golf player, in order to evaluate the quality of repulsion from this speed and the speed at which the ball bounces back. The heads implementing the present invention and a conventional product head were tested.

Figure 7:
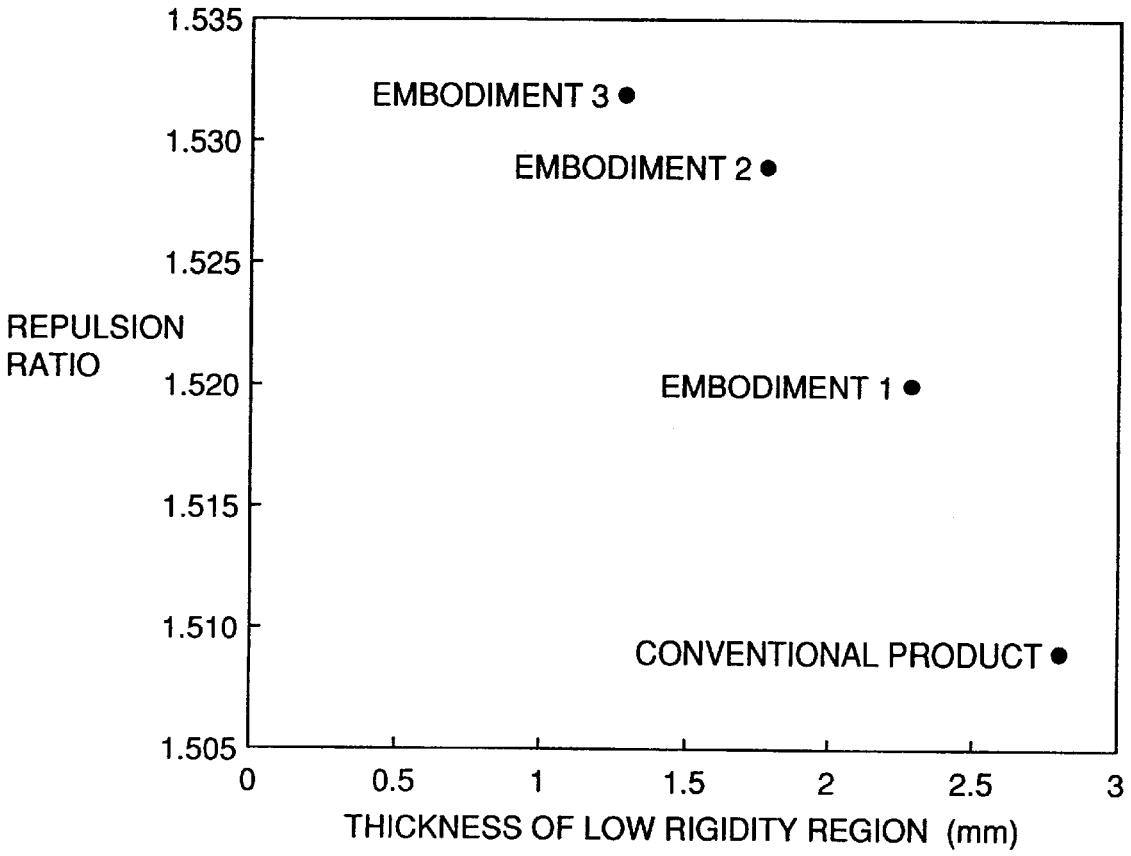
FIG. 7 is a graph representing the measurement results in relation to the repulsion in another embodiment of the present invention.

The results are shown in FIG. 7 as the repulsion ratios of both the inventive and conventional heads.

Here, the repulsion ratio was calculated in the same manner as that of the metal iron golf club heads described earlier.

As can be seen from FIG. 7, the repulsion ratios for all the inventive products are higher in comparison with that of the conventional product. Moreover, among the embodiments, the repulsion ratio of embodiment 3 indicated the largest value. It was found that an embodiment having a thinly formed low rigidity region and having a natural frequency close to that of the ball natural frequency had a good repulsion ratio.

As described above, according to the present invention, in a metal iron golf club head having a hollow portion, by reducing the rigidity in the portion on the heel side of the head portion, the natural frequency of the head can be brought closer to the natural frequency of the ball without reducing the strength of the face, while improving the repulsion between the head and the ball.

INDUSTRIAL APPLICABILITY

As seen from the above, according to the present invention, by forming the face thickness of a part or all of the medium sensitivity region of the face member of a metal golf club head thinner than the face thickness of an average value in the low sensitivity region, the natural frequency of the metal golf club head can be brought closer to the natural frequency of the ball without reducing the strength of the face, while improving the repulsion between the head and the ball.

What is claimed is:

1. A metal golf club head formed by a head body and a face member formed of different materials, said head body including a toe side, a heel side, a top side, and a sole side, and having an opening that penetrates from one side of a face to an opposite side of the face with said face member fit into the opening, wherein a medium sensitivity region and a low sensitivity region are provided on a face portion for hitting a ball, a region in which a face thickness of a part or all of said medium sensitivity region is made thinner than a face thickness in a vicinity of a face center portion that exists within said low sensitivity region is defined as a low rigidity region, and with an X-axis being a direction from said toe side to said heel side (the heel direction being positive), a Y-axis being a direction from said top side to said sole side (the top direction being positive), and an origin point being coordinates where said X-axis and said Y-axis cross at said face center, said low rigidity region includes a region enclosed by a curved line that passes through a first point having X-axis and Y-axis coordinates of 0.38 mm and 16 mm and a second point having X-axis and Y-axis coordinates of −15 mm and −15 mm and that has a first prescribed radius and by an outer circumference of said face portion, and a region enclosed by a curved line that passes through a third point having X-axis and Y-axis coordinates of 15 mm and −17 mm and a fourth point having X-axis and Y-axis coordinates of 25 mm and 5 mm and that has a second radius smaller than said first prescribed radius and by the outer circumference of said face portion.

2. The metal golf club head according to claim 1, wherein a region within said medium sensitivity region and having its face thickness made thin is defined as a low rigidity region, and an area of said low rigidity region is 5% to 50% of the face area.

3. The metal golf club head according to claim 2, wherein a region other than said low rigidity region in said face member is defined as a high rigidity region, and the face thickness of said low rigidity region is formed at least 0.2 mm thinner than the thickest face thickness of said high rigidity region.

4. The metal golf club head according to claim 3, wherein the face thickness of said low rigidity region is selected to be 0.5 to 2.7 mm.

5. The metal golf club head according to claim 3, wherein a material having a tensile strength of 100 kgf/mm$^2$ or greater and having a Young's modulus of elasticity of 10000 kfg/mm$^2$ or lower is used for said face member.

6. The metal golf club head according to claim 2, wherein the face thickness of said low rigidity region is formed at least 0.5 mm thinner than the thickest face thickness of said high rigidity region.

7. The metal golf club head according to claim 6, wherein the face thickness of said low rigidity region is selected to be 0.5 to 2.7 mm.

8. The metal golf club head according to claim 6, wherein a material having a tensile strength of 100 kgf/mm$^2$ or greater and having a Young's modulus of elasticity of 10000 kfg/mm$^2$ or lower is used for said face member.

9. The metal golf club head according to claim 2, wherein the face thickness of said low rigidity region is selected to be 0.5 to 2.7 mm.

10. The metal golf club head according to claim 2, wherein a material having a tensile strength of 100 kgf/mm$^2$ or greater and having a Young's modulus of elasticity of 10000 kfg/mm$^2$ or lower is used for said face member.

11. The metal golf club according to claim 1, wherein a material having a tensile strength of 100 kgf/mm$^2$ or greater and having a Young's modulus of elasticity of 10000 kfg/mm$^2$ or lower is used for said face member.

* * * * *